United States Patent [19]

Stephens et al.

[11] Patent Number: 4,993,490

[45] Date of Patent: Feb. 19, 1991

[54] OVERBURN PROCESS FOR RECOVERY OF HEAVY BITUMENS

[75] Inventors: David J. Stephens, London, England; Roland P. Leaute, Calgary, Canada

[73] Assignee: Exxon Production Research Company, Houston, Tex.

[21] Appl. No.: 416,554

[22] Filed: Oct. 3, 1989

[30] Foreign Application Priority Data

Oct. 11, 1988 [CA] Canada ..... 579473

[51] Int. Cl.[5] ..... E21B 43/24; E21B 43/243

[52] U.S. Cl. ..... 166/261; 166/263; 166/272

[58] Field of Search ..... 166/245, 256, 261, 263, 166/268, 271, 272

[56] References Cited

U.S. PATENT DOCUMENTS

| | | | |
|---|---|---|---|
| 3,036,935 | 3/1962 | Allen et al. . | |
| 3,064,728 | 11/1962 | Gould | 166/261 |
| 3,111,986 | 11/1963 | Kuhn, Jr. . | |
| 3,334,687 | 8/1967 | Parker . | |
| 3,358,754 | 12/1967 | Stelzer et al. . | |
| 3,375,870 | 4/1968 | Satter et al. | 166/263 X |
| 3,441,083 | 4/1969 | Fitzgerald | 166/245 |
| 3,472,318 | 10/1969 | Woodward | 166/245 |
| 3,608,637 | 9/1971 | Lumpkin et al. | 166/256 |
| 3,987,851 | 10/1976 | Tham | 166/256 |
| 4,124,071 | 11/1978 | Allen et al. | 166/245 X |
| 4,392,530 | 7/1983 | Odeh et al. | 166/269 |
| 4,503,910 | 3/1985 | Shu | 166/263 |
| 4,566,537 | 1/1986 | Gussis | 166/261 |
| 4,593,759 | 6/1986 | Penick | 166/261 |
| 4,722,395 | 2/1988 | Venkatesan | 166/261 |
| 4,860,827 | 8/1989 | Lee et al. | 166/272 X |

FOREIGN PATENT DOCUMENTS

| | | | |
|---|---|---|---|
| 1020861 | 11/1977 | Canada | 166/261 |

*Primary Examiner*—George A. Suchfield
*Attorney, Agent, or Firm*—Pamela L. Wilson

[57] ABSTRACT

A method for the production of bitumen from a subterranean reservoir having a zone of increased effective permeability therein. In particular, a first well is in fluid communication with the zone of increased effective permeability at a first level in the reservoir. Fluid communication is established between a second well and the zone of increased effective permeability at a second level above the first level in the reservoir. In-situ combustion is initiated in the reservoir proximate the second well. Combustion sustaining fluid is injected through the second well into the zone of increased effective permeability so that bitumens in the reservoir are mobilized by the in-situ combustion and flow downward through the reservoir towards the first well, through which they are recovered. By using this method, a stable in-situ combustion process is established which avoids fingering and channelling and accompanying early oxygen breakthrough, consequently improving the efficiency of bitumen production from the reservoir.

11 Claims, 6 Drawing Sheets

OVERBURN PROCESS FOR RECOVERY OF HEAVY BITUMENS

FIELD OF THE INVENTION

The invention relates generally to the production of hydrocarbons from subterranean reservoirs. This invention relates more particularly to the production of bitumens from underground tar sand beds.

BACKGROUND OF THE INVENTION

Throughout the world there exist numerous subterranean tar sand formations containing high-density, high-viscosity bitumens which resist recovery by conventional means. The vast Athabasca tar sand field in Alberta Province, Canada represents one of the most notable examples of such formations. The Cold Lake deposits in the same province represent a similar formation.

A variety of methods have been proposed for improving the production of hydrocarbons from these formations by increasing their mobility, including both solvent injection and thermal steam stimulation processes. One currently utilized method is the cyclical steam stimulation ("CSS") process. In this method, an injection-production well is sunk into the bitumen-bearing formation and completed at a given depth, usually by perforation, so as to establish fluid communication between the well and the formation. Steam is injected through the injection-production well into the formation to mobilize the bitumens. The injection pressure is usually maintained above a threshold value corresponding to that required to maintain formation fracturing and parting to sustain practical injection rates. Steam injection is subsequently terminated and, often following some shut-in period, hydrocarbon containing fluids are produced from the same well.

In the course of successive CSS cycles, the reservoir in the vicinity of the injection-production well becomes depleted and a vapor zone forms about the well during the depressurization phase of each cycle. This is because CSS standard operating practice is to flow back or pump off from the formation a greater volume of fluids than the cold water liquid equivalent volume of steam which as been injected; the "voids" thus created fill with steam vapor or solution gas. During subsequent CSS cycles, bitumens which have been mobilized by the steam, which exist mostly in a liquid phase, move back downward through the vapor zone to the completion level of the injection-production well, where they enter the well via the perforations and are produced from the reservoir. Conversely, the injected steam moves through this vapor zone in an upward direction from the completion level of the injection-production well, due to the difference in densities between steam or vapor and formation liquids. The CSS process thus tends to mobilize and recover bitumens from an area of the reservoir which extends upwardly from the completion level of the injection-production well. Accordingly. CSS injection-production wells are typically completed near the lower oil horizon in the reservoir in order to maximize the portion of the reservoir which can be exploited by each well.

As described, the injected steam tends to move in an upward direction through the vapor zone; simultaneously, its thermal energy tends to diffuse outwardly into the reservoir. Due to this combined upward and outward spread of stimulating effects, the CSS process tends to mobilize and drain bitumens from a region of the reservoir which has a progressively greater horizontal cross-section at progressively higher levels in the reservoir. Each such region thus tends to be hemi-ellipsoidal, or bowl-shaped, in form, having a lower boundary (with respect to the portion of the reservoir which has not been mobilized) which slopes generally upward with a substantially positive gradient in an outward direction from the CSS injection-production well. In some reservoirs, the drained region may be lens-shaped or some other form having a lower boundary with a substantially positive gradient outwardly from an injection-production well, depending on formation characteristics and CSS injection techniques. "Substantially positive gradient" as used herein means a generally upward rate of inclination from a particular horizontal direction.

The drained region will have increased effective permeability relative to the non-mobilized portion of the reservoir due to the reduced presence of high-density, high-viscosity bitumens therein. As used herein, "increased effective permeability" refers to increased effective relative permeability to the gas phase. Gas-phase injection fluids, including steam in particular, will consequently flow much more readily through the region of increased effective permeability than through the remainder of the reservoir. As a result, heat penetration and additional bitumen mobilization during subsequent CSS cycles will take effect primarily at the boundaries of the bowl-shaped region.

In order to drain a larger area of a tar sand bed or similar field, a plurality of spaced-apart CSS injection-production wells may be used together in a coordinated pattern. The injection-production wells may be arranged in rows, clusters, or any of a variety of patterns known to those skilled in the art and selected to drain a particular reservoir. Because each of these CSS injection-production wells tends to mobilize and drain bitumens from a bowl-shaped region which has a progressively larger horizontal cross-section at progressively higher levels in the reservoir, the resulting regions of increased effective permeability about the injection-production wells eventually tend to override and intersect each other at upper elevations in the reservoir. Areas of communication are thus formed between the regions of increased effective permeability at upper elevations in the reservoir while non-mobilized regions of the reservoir still exist between the wells in the lower elevations. These non-mobilized regions are known to those skilled in the art as "cold-humps" and represent bodies of unrecovered hydrocarbons remaining in the reservoir. For reasons discussed below in connection with the description of the present invention, these cold humps resist recovery by further conventional cyclical steam stimulation via the injection-production wells, which renders the CSS process less economical in its later stages.

Although the preceding discussion has described the results of a typical CSS process, when applied to recovery of bitumens from a representative tar sand bed, those skilled in the art will recognize that there exist other methods of primary recovery of bitumens, such as conventional steam drive or solvent injection processes, which may result in similar conditions in a reservoir. It will be understood that the method of the present invention will be applicable to the recovery of bitumens from reservoirs having such similar conditions as a result of such other primary recovery methods, as well as to those wherein such conditions are the result of a CSS recovery process.

Still other methods which have been proposed for improving the production of hydrocarbons from tar sand beds and like formations include those which utilize in-situ combustion processes. In a typical in-situ combustion process, combustion is initiated or ignited in the cold reservoir and a combustion-sustaining fluid, typically air, is supplied to the combustion zone so as to expand the combustion front outwardly into the reservoir, thereby mobilizing the heavy bitumens.

One example of an in-situ combustion process is that disclosed in U.S. Pat. No. 3,441,083 (Fitzgerald), issued Apr. 29, 1969. Forward steam injection is first performed through the bottom portion of the formation from steam injection wells to spaced-apart production wells. In-situ combustion is then started in the top portions of the reservoir and sustained by air injected downwardly into the formation through injection wells. The heat and pressure created by the in-situ combustion, in combination with the heat and fluid flow provided by the steam injection, gravity, and thermal expansion, are intended to cause the hydrocarbons in the reservoir to flow downwardly in the reservoir, where they are then carried along to the production wells by the forward injection from the steam injection wells.

Although some similar processes utilizing in-situ combustion drive have, to a certain extent, proven workable in the recovery of bitumens from tar sand beds and similar formations, the low injectivity into the cold reservoir regions due to very low effective permeability of the formation results in a natural tendency for the combustion front, or "burn," to channel through the formation between the injection and production wells instead of evenly expanding through the formation. This channelling frequently leads to air or oxygen breakthrough and fingering of the burn, and consequently results in inefficient oxygen utilization and ineffective recovery of bitumens from the reservoir.

Consequently, there is still needed an efficient method for recovering bitumens from reservoirs containing heavy bitumens. Such a method would improve the total percentage recovery of bitumens from tar sand beds and like formations and would make it much more economical to produce hydrocarbons from such formations.

SUMMARY OF THE INVENTION

Briefly, the present invention involves a method for recovering bitumens from a subterranean reservoir which is penetrated by a plurality of spaced-apart wells and in which zones of increased effective permeability or injectivity in the reservoir have been formed about at least one first well. The zones of increased effective permeability preferably have been formed by cyclically injecting steam into, and producing bitumens from, the reservoir via the first well. However, the zones may have been formed by a steam drive production process, solvent injection process, or any other suitable production process which results in similar such zones, and the present invention will work in such cases with similar results. The zones of increased effective permeability have a lower boundary in the reservoir which has a substantially positive gradient outwardly from the first well for the reasons outlined above. In-situ combustion is initiated preferably within the zone of increased effective permeability surrounding the first well(s) at a second, spaced apart well, and combustion supporting fluid is injected into the zone of increased effective permeability via the second well. The in-situ combustion may be initiated at a location adjacent to, rather than within, the zone of increased effective permeability, or at a location where the zone of increased effective permeability is poorly established, in which cases the reservoir may be conditioned for in-situ combustion by injection of high pressure steam through the second well. The heat of the in-situ combustion, combustion pressure, and gravity cause at least a portion of the remaining bitumens in the reservoir to flow downward through the zone of increased effective permeability towards the first well. The bitumens are produced from the reservoir via the first well.

These and other features of the present invention will be more readily understood by those skilled in the art from a reading of the following detailed description with reference to the accompanying drawings.

DESCRIPTION OF THE PREFERRED EMBODIMENT

The present invention involves a method for the production of bitumens from a reservoir by use of in-situ combustion in a zone of increased effective permeability or injectivity about a production well. The details of a preferred embodiment of the invention utilizing cyclical steam injection will be described below.

Figure 1:
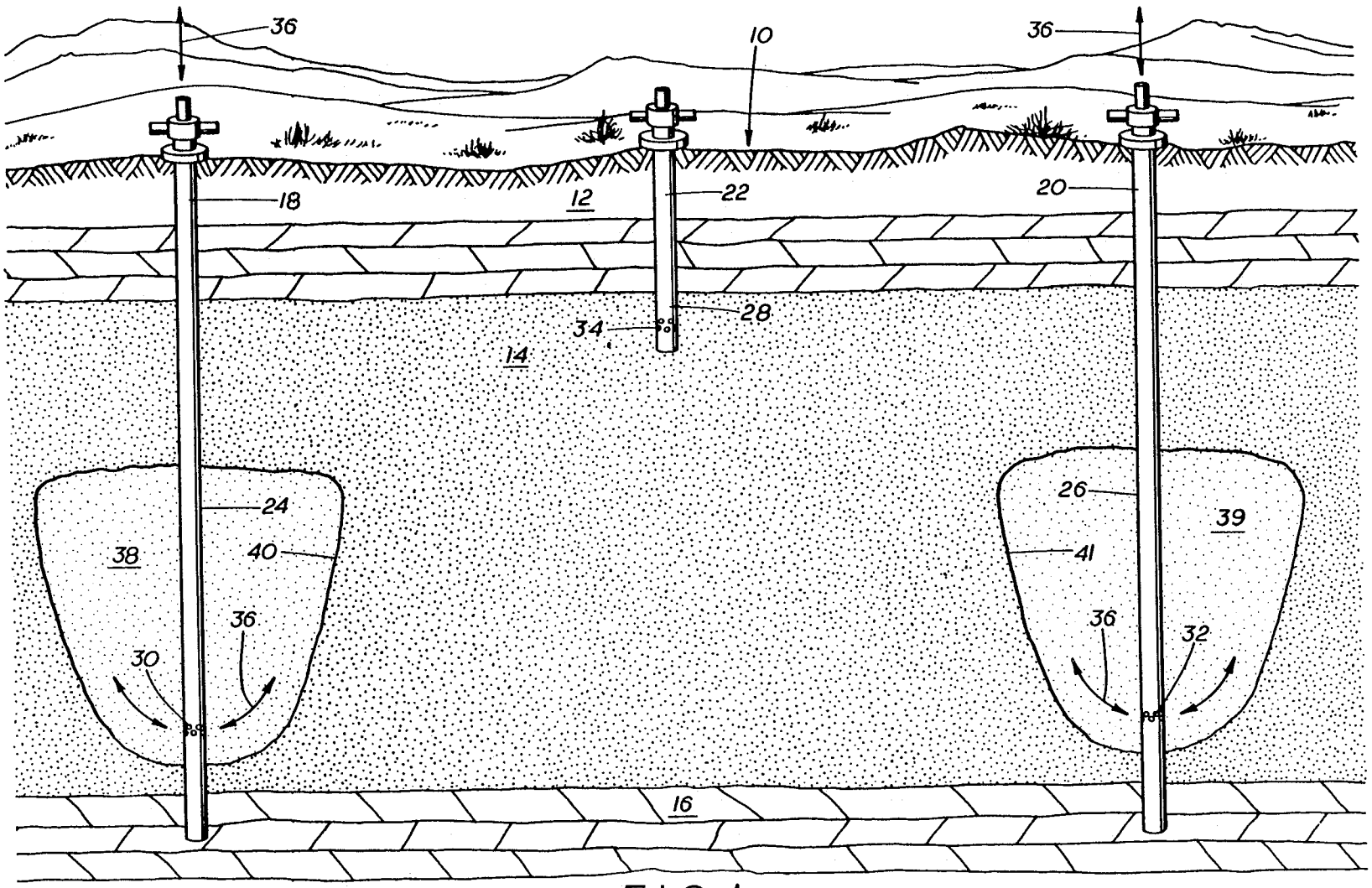
FIG. 1 is a partial, cross-sectional view of a formation having a reservoir containing high-density, high-viscosity bitumens, which is penetrated by two CSS injection-production wells and one in-situ combustion injection well, showing an initial phase of cyclical steam stimulation of the reservoir in the practice of the present invention.

With reference to FIG. 1, terrain, or field, 10 is shown to include overburden 12 lying over reservoir 14 containing high-density, high-viscosity bitumens. Reservoir 14 is underlain by stratum 16. The presence of the high-density, high-viscosity bitumens causes low effective permeability or injectivity within reservoir 14 in its original condition. Spaced-apart injection-production wells 18 and 20 and injection well 22 are drilled in the field 10 into the reservoir. Wells 18, 20, and 22 are drilled and completed in a conventional manner and extend from the surface of field 10 downwardly into reservoir 14. Two injection-production wells are shown; however, it should be understood that the method of the present invention is applicable to use with as few as one injection-production well, as well as to use with any other number of injection-production wells disposed in any suitable pattern or configuration. Similarly, it should be understood that, while FIG. 1 shows one injection well, the method of the present invention is applicable to use with any greater number of injection wells.

In the embodiment described herein the zones of increased effective permeability have been established by a cyclical steam injection process; it will be obvious to those skilled in the art, however, that the zones may be the result of any number of suitable methods of mobilizing and extracting at least a portion of the bitumens within such a reservoir, such as, for example, solvent injection or steam drive processes, which produce similar such conditions in the reservoir.

With further reference to FIG. 1, it will be seen that wells 18, 20, and 22 are provided with casings 24, 26, and 28 respectively, which are cemented in a conventional manner so as to prevent the flow of steam or other injected fluid along the axis of the wells between the well casings 24, 26, and 28 and the well bores (not shown). It should also be noted at this point that, depending on conditions, it may be desirable to either drill injection well 22 at the same time the original CSS injection-production wells 18 and 20 are drilled, or infill-drill (drill in between) injection well 22 between injection-production wells 18 and 20 at some later time, following a period of CSS operation.

With further reference to FIG. 1, the next steps of the method of the present invention will be described. Each well casing 24, 26, and 28 is perforated in a conventional manner to provide a plurality of holes or perforations 30, 32, and 34, which establish fluid communication between each well and reservoir 14. Although such communication is here described as being established by perforation, such communication may be established by any suitable method of forming an opening through the casing and surrounding cement.

Injection-production wells 18 and 20 are preferably each perforated at levels in reservoir 14 which are selected so that they can most effectively drain bitumens from the reservoir using a cyclical steam stimulation process. As previously described, the mobilizing effects of injected steam tend to spread upwardly and outwardly into a reservoir; consequently cyclical steam stimulation wells are normally perforated near the lower oil horizon in a reservoir. With reference to FIG. 1, it will be seen that injection-production wells 18 and 20 are perforated at levels in the lower part of reservoir 14.

Next, steam is injected into reservoir 14 and bitumen-containing fluids are produced from reservoir 14, via wells 18 and 20 and through perforations 30 and 32, alternately in the directions indicated by arrows 36. As bitumen-containing fluids (which may also contain large amounts of steam condensate) are produced from reservoir 14, they "vacate" expanding regions or zones 38 and 39 of reservoir 14, in the manner previously described. Regions or zones 38 and 39, due to the depletion of bitumens, possess increased effective permeability relative to those portions of the reservoir from which bitumens have not been mobilized and produced. Gas-phase fluids, including both steam and mobilized bitumens, are able to flow much more readily through zones 38 and 39 of increased effective permeability than through the remainder of reservoir 14. Simultaneously, increased temperature and thermal cracking effects in zones 38 and 39, resulting from the steam injection, reduce the viscosity of fluids in zones 38 and 39 and make it much easier for liquid-phase fluids to flow through the zones as well. As previously described and shown by arrows 36, the mobilizing effects of CSS tend to spread upwardly and outwardly in the reservoir 14, producing bowl-shaped zones 38 and 39 of increased effective permeability about the injection-production wells. It will consequently be seen that the lower boundaries 40 and 41 of each zone 38 and 39 respectively (the lower boundary between the zones of increased effective permeability and the remainder of the reservoir) slope generally upwardly and outwardly away from their respective injection-production wells; each boundary 40 and 41 therefore possesses a generally positive gradient outwardly from its respective injection-production well.

Figure 2:
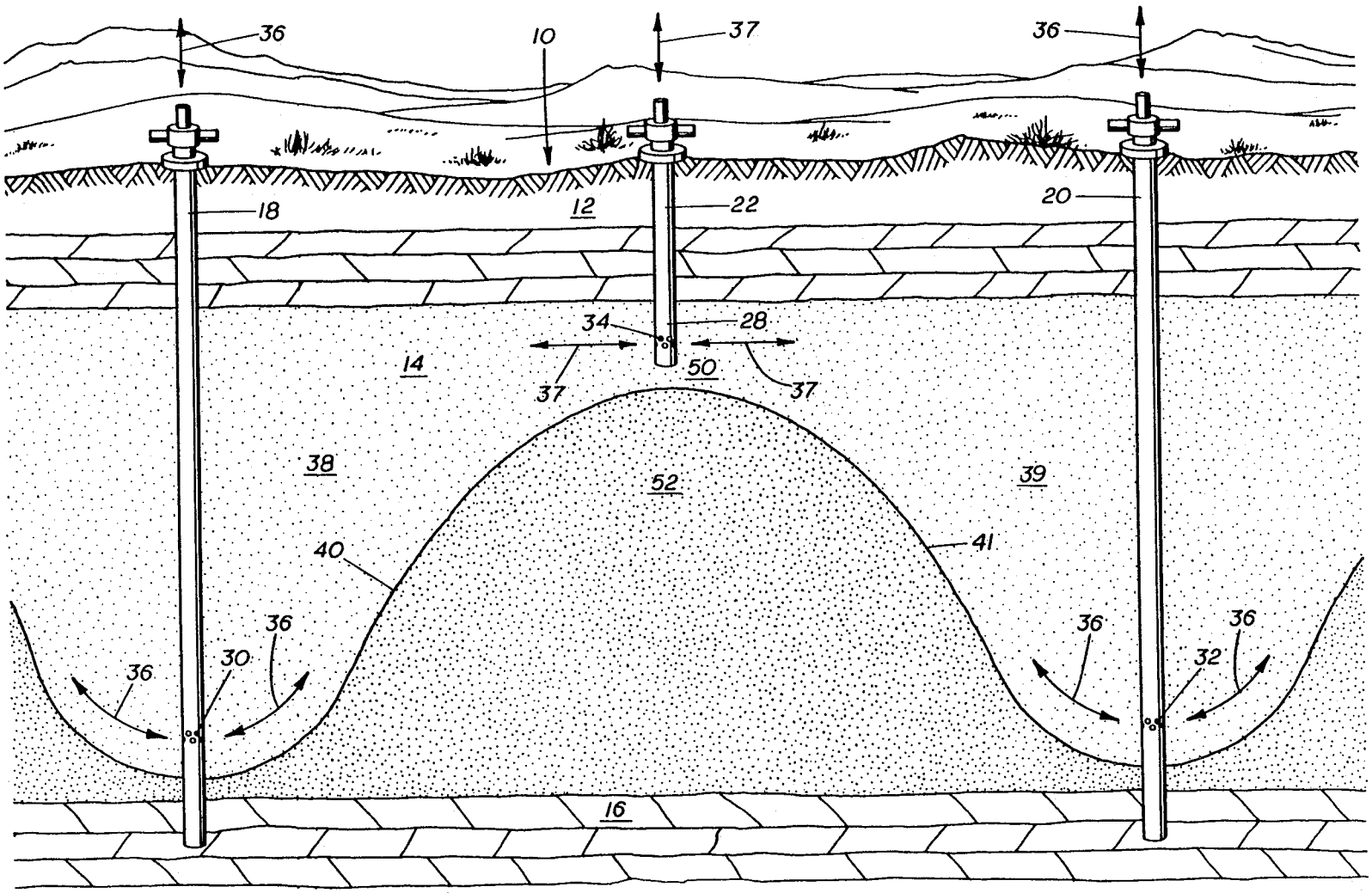
FIG. 2 is a partial, cross-sectional view of the same formation and wells shown in FIG. 1, during a phase of the present invention in which zones of increased effective permeability have been formed about the CSS injection-production wells and initial conditioning of an area of communication between the zones of increased effective permeability is performed by high pressure steam injection through the in-situ combustion injection well.

With reference now to FIG. 2, subsequent steps in the method of the present invention will be described. In the course of repeated injection and production cycles as described above, the zones 38 and 39 of increased effective permeability spread further and further outwardly about wells 18 and 20 as they extend upwardly into the reservoir. Eventually, the upper parts of zones 38 and 39 reach each other in the upper levels of reservoir 14, and intersect to form an area of communication 50 between the zones 38 and 39. Between wells 18 and 20 and below area of communication 50, however, there remains cold hump 52, a body of unrecovered bitumens which have not been mobilized and recovered by the cyclical steam stimulation at the time area of communication 50 forms.

The remaining bitumens in cold hump 52 resist recovery by subsequent cyclical steam stimulation for several reasons. First, cold hump 52 lies generally outside of the path of the mobilizing effects of the steam stimulation, as described above. Furthermore, both the area of communication 50 and the interface of zones 38 and 39 with overburden 12 make it difficult to generate sufficient steam pressure in zones 38 and 39 to penetrate the heavy bitumens in cold hump 52. More significantly, however, during each of the injection cycles the steam vapor condenses as it releases its latent heat to formation rock in reservoir 14; progressively, a pool or sump of mostly hot water accumulates at the bottom of zones 38 and 39 near perforations 30 and 32. This pool of water provides inefficient contact and energy transfer for the injected steam to access and mobilize bitumens from cold hump 52. In addition, in the course of each cycle this hot water pool must be flowed back through the wells 18 and 20 prior to collecting more valuable higher bitumen cuts. This combination of factors renders the CSS process inefficient and difficult to operate profitably in the later cycles. At this point an operator using conventional CSS techniques may decide to access new virgin tar sand beds through expansion drilling within its tar sands leases, rather than continue with the existing CSS operation, leaving the bitumens in cold hump 52 unrecovered.

Inasmuch as the method of the present invention may desirably be used for secondary recovery of bitumens from such reservoirs where conventional CSS operations have been terminated, a significant period of time may pass between the completion of the previous described phases and the subsequent steps described below.

Injection well 22 preferably penetrates reservoir 14 proximate the uppermost portion or peak of cold hump 52. Injection well perforations 34 are at a position which is spaced apart from, and preferably axially (with respect to the well axes) offset from, the perforations of injection-production wells 18 and 20, and are at a level which is selected to establish fluid communication between injection well 22 and reservoir 14 within the area of communication 50 between the zones of increased effective permeability 38 and 39. Hence, in the preferred arrangement shown, injection well 22 is in fluid communication with area of communication 50 proximate the peak of cold hump 52 and above the level of the perforations 30 and 32 of injection-production wells 18 and 20. It will be observed, however, that because an injection-production well is in fluid communication with the bowl shaped zone of increased effective permeability at its lowest point, virtually any injection well which is spaced apart from the injection-production well and which also is in fluid communication with the zone of increased effective permeability 30 will normally be in fluid communication with the reservoir at a higher level than the injection-production well.

It is possible that, under some circumstances, perforations 34 of injection well 22 may not initially intersect area of communication 50 created between injection-production wells 18 and 20, or that area of communication 50 itself may be poorly established. In this event, it may be desirable to initially inject high pressure steam into injection well 22 and through perforations 34, either cyclically or non-cyclically in the direction shown by arrows 37, in order to penetrate the tar sand bed until adequate fluid communication is established with area 50. Such initial steam injection through injection well 22 may also be advantageous in situations where the perforations 34 are in direct fluid communication with area of communication 50 to better condition the area of communication 50 for the subsequent steps in the method of the present invention.

Figure 3:
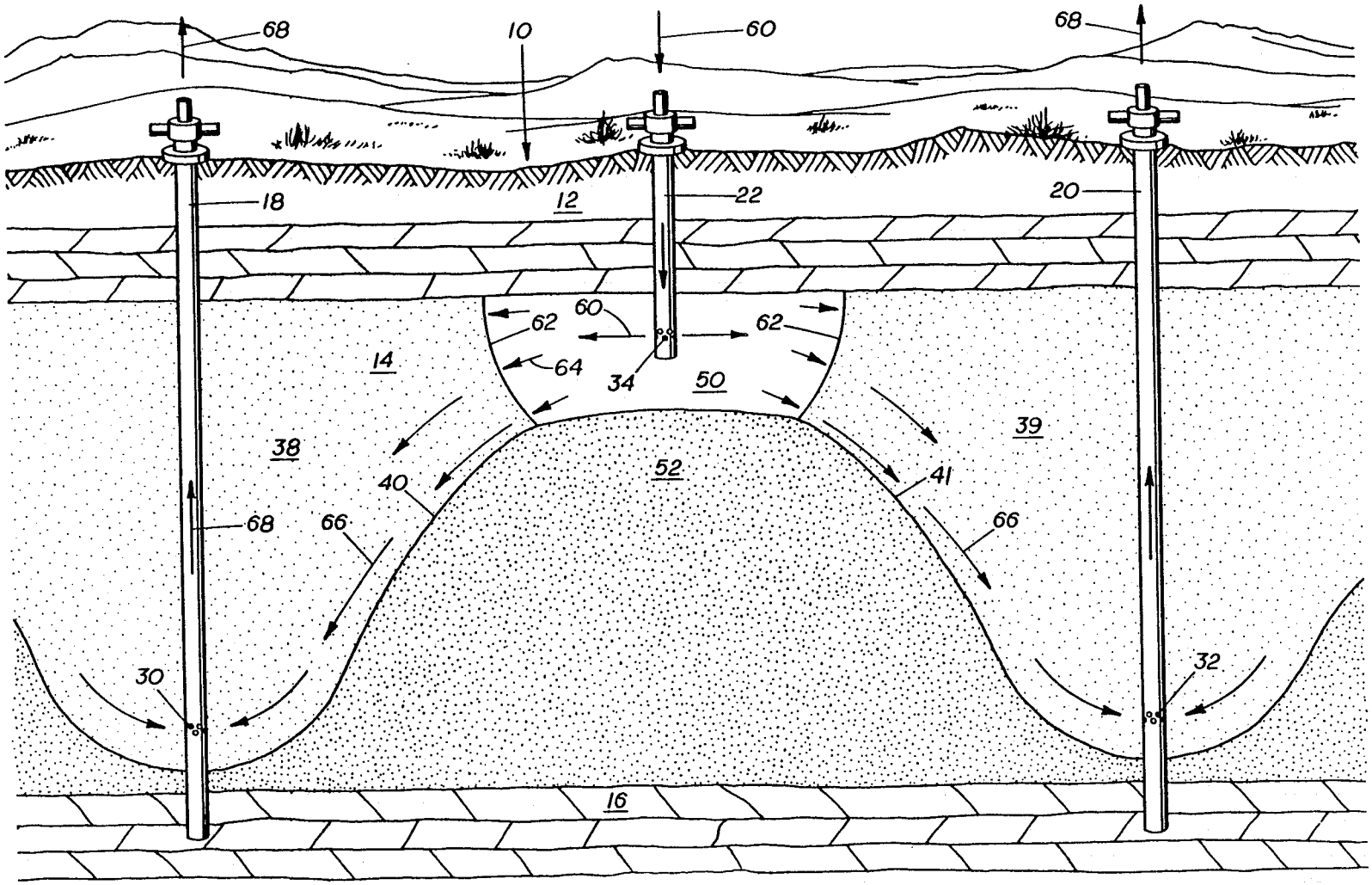
FIG. 3 is a partial, cross-sectional view of the same formation and wells shown in FIG. 2, during a phase of the present invention in which in-situ combustion is initiated proximate the in-situ combustion injection well and combustion-supporting fluid is injected into the formation through the injection well.

With reference now to FIG. 3, the next steps in the method of the present invention will be described. In-situ combustion is initiated proximate injection well 22 by any suitable means known to those skilled in the art, as, for example, by means of a gas-fired or electrical heater or igniter (not shown). Combustion-supporting fluid is then injected downwardly through injection well 22 and thence outwardly through perforations 34 into reservoir 14 in the direction indicated by arrows 60, in order to sustain and expand the in-situ combustion. If the previously described step of initial steam injection via injection well 22 and perforations 34 has been utilized, area 50 may already be preheated to a temperature sufficiently high to result in initiation of the in-situ combustion by autoignition of bitumens remaining in area 50 when those bitumens are contacted by the injected combustion supporting fluid, thus eliminating the need for a heater or igniter to initiate the in-situ combustion. The combustion-supporting fluid itself may be any suitable gas-phase fluid known to those skilled in the art which is adapted to sustain the in-situ combustion in the reservoir. The combustion-supporting fluid is preferably an oxygen-containing fluid, and may be air or oxygen-enriched air.

As the combustion-supporting fluid is injected into reservoir 14 via injection well 22, the pressure of the injected fluid and the pressure generated by the combustion (due in large part to the production of carbon dioxide) drive the in-situ combustion front 62 outwardly in the direction indicated by arrows 64. As combustion front 62 expands outwardly, the combined effects of the heat release of the combustion reaction, thermal cracking upgrading (which breaks the bitumens into less viscous compounds), vaporization, combustion pressure, and gravity cause the remaining bitumens in reservoir 14—both those in cold hump 52 and those remaining in the zones of increased permeability 38—to be mobilized and move downwardly in reservoir 14. Because the mobilized bitumens move downwardly under the effect of gravity, but more readily through heated zones of increased permeability 38 than through cold hump 52, the mobilized bitumens tend to flow along the lower boundaries 40 and 41 of zones 38 and 39 in the direction indicated by arrows 66. The mobilized bitumens thus tend to flow towards perforations 30 and 32 of wells 18 and 20, respectively, via which they are produced at the surface in the direction indicated by arrows 68.

Figure 4:
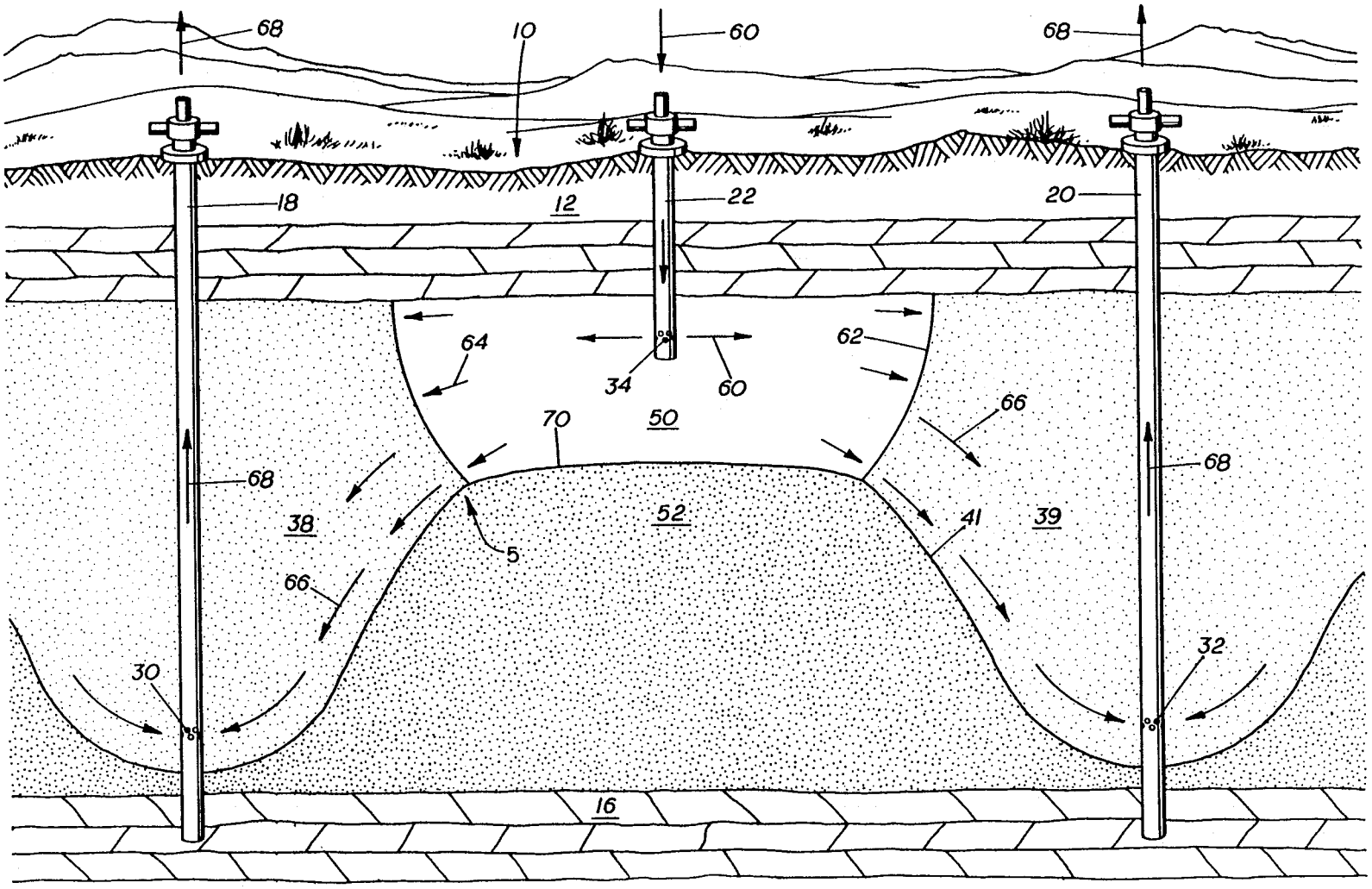
FIG. 4 is a partial, cross-sectional view of the same formation and wells shown in FIG. 3, during a phase of the present invention in which the in-situ combustion shown in FIG. 3 is expanded outwardly from the in-situ combustion injection well and bitumens are mobilized and depleted from the reservoir.

FIG. 4 shows the arrangement of FIG. 3 following an extended period of in-situ combustion as described with respect to FIG. 3. It will be seen that combustion front 62 has expanded further outwardly in the direction indicated by arrows 64, as combustion-supporting fluid has continued to be injected via injection well 22 in the direction indicated by arrows 60. As bitumens are mobilized and produced as previously described, cold hump 52 is reduced due to depletion of bitumens from its top 70.

As the in-situ burn proceeds, the heat generated tends to spread through the reservoir, via both conduction through the formation and convection with the flow of hot fluids. As previously described, hot bitumens continue to drain towards the injection-production wells under the influence of gravity, pressurization of the burned zone and additional thermal cracking and vaporization transport effects. At the same time, the majority of the carbon dioxide produced in the process tends to flow outwardly from the burned zone and into the reservoir, thereby creating a sweep through the reservoir and having some solvent effect on the bitumens as well. Because the production points are located low in the reservoir at the injection-production wells, this sweep through the reservoir by the produced carbon dioxide will tend to be gravity stabilized, and the likelihood of oxygen breakthrough or fingering of the burn will thereby be minimized. In order for this stabilized process to be effectively implemented, however, fluids must be able to flow readily through the reservoir in the region of the injection well. This is achieved in the method of the present invention by the employment of the CSS process (or other suitable process) to form the heated zones of increased effective permeability about both the injection-production and injection wells, through which the carbon dioxide and combustion-supporting fluid may readily flow into the reservoir, and through which the mobilized bitumens can readily drain away out of the reservoir. Thus, one advantage of the present invention over the conventional types of combustion drives is that it utilizes factors which ordinarily cause a tendency for the burn to override between injection and production wells—gravity and the carbon dioxide sweep effect—to instead attain an inherently stable process.

Figure 5A:
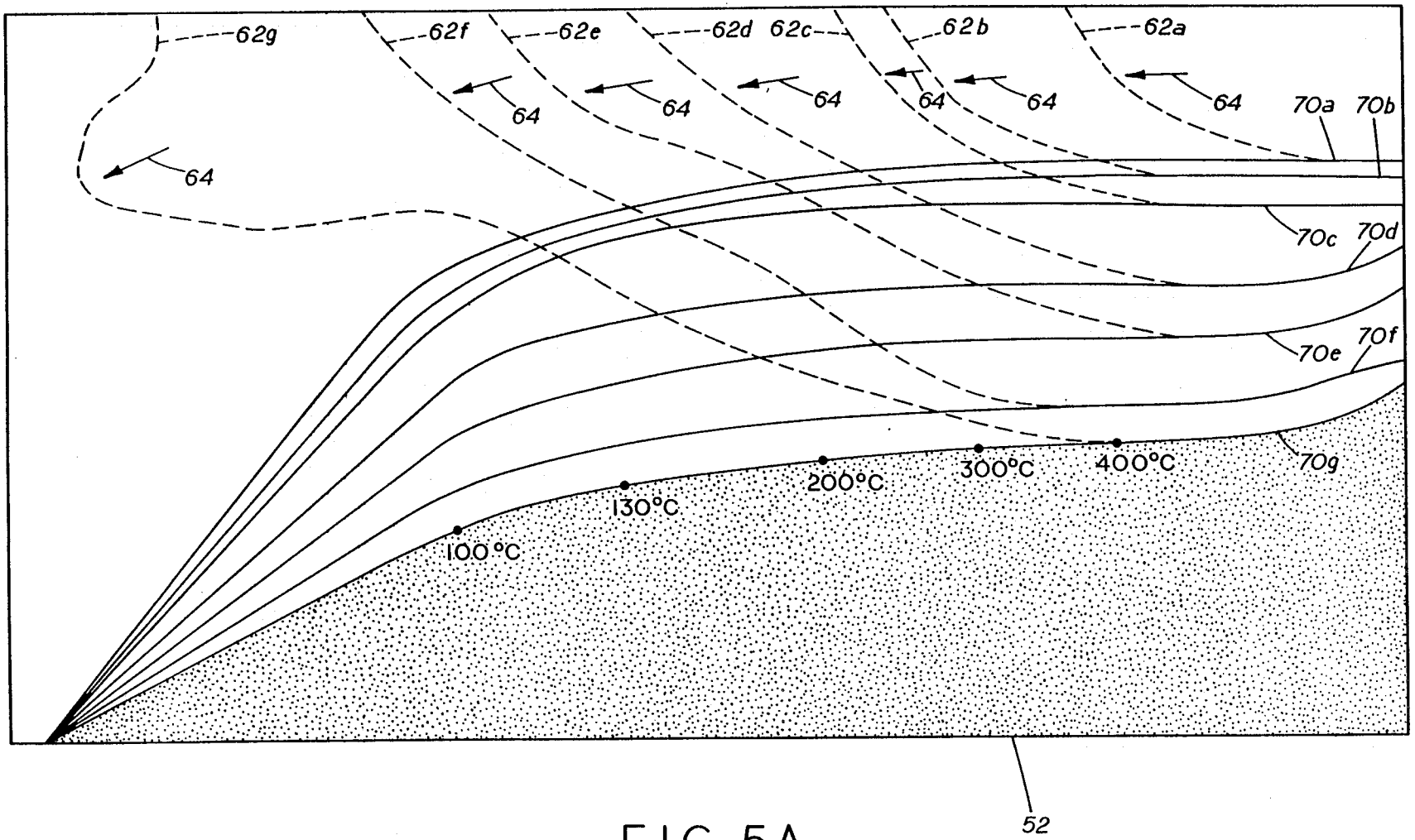
FIG. 5A is an enlarged partial, cross-sectional view of the portion of the formation of FIG. 4 which is indicated by reference numeral 5, showing the penetration of heat in the reservoir and the corresponding depletion of bitumens.

With reference now to FIG. 5A, the mobilization of bitumens from cold hump 52 under the expanding burn zone will be described. FIG. 5A is an enlarged view of that portion of reservoir 14 shown in FIG. 4 which is indicated by reference numeral 5. The progression illustrated in FIGS. 5A and 5B was observed as the result of an experimental two-dimensional model test using the method of the present invention. With reference to FIG. 5A, the progression of the combustion front over time is indicated by the series of dashed lines 62 a–g, expanding in the direction indicated by arrows 64 in the manner previously described. Solid lines 70 a–g represent the approximate locations of the undepleted bitumen interfaces at the top 70 (see FIG. 4) of cold hump 52, which correspond in time to combustion front locations 62 a–g. It will be observed that, as time progresses, the undepleted bitumen interface moves downward as bitumens are mobilized and recovered from the top of cold hump 52. Also, it can be seen that each of the progressive series of interfaces 70 a–g shows a positive gradient, important for effective bitumen drainage, between the injection-production well (to the left) and the lowest point of each of the combustion fronts 62 a–g.

Figure 5B:
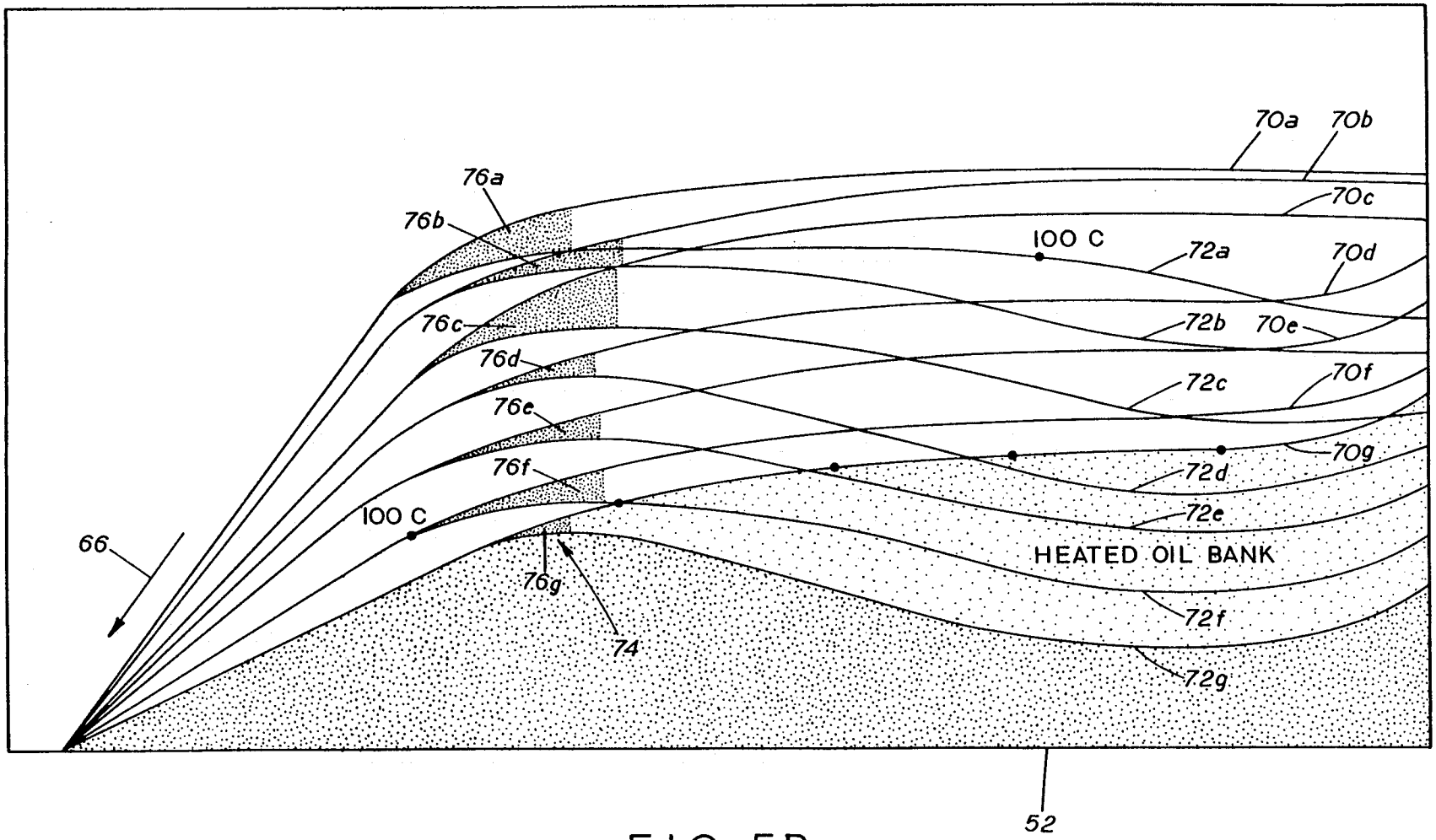
FIG. 5B is a cross-sectional view of the portion of the formation shown in FIG. 5A, showing the penetration of heat below undepleted bitumens in the reservoir.

With reference now to FIG. 5B, the penetration of heat into the region located below the undepleted bitumen interface will be described. FIG. 5B shows that portion of the reservoir shown in FIG. 5A, as the combustion front expands therethrough as previously described. With reference to FIG. 5B, each line 70 a–g represents the position of the receding undepleted bitumen interface at the top of cold hump 52. Lines 72 a–g each represent the lower boundary of a bank of heated bitumen below the corresponding interface. The bitumens in the heated bank are sufficiently hot (>100° C. in the experimental model test) to be mobile in the zone of increased effective permeability in the reservoir. At all times, the heated bitumen in the zone resembles a tongue 76 a–g which spills over a lip 74 of cold hump 52 downstream of the position of the corresponding combustion front. That portion of the heated bitumen which spills over the lip drains downward towards the injection-production well, via which it is recovered, while some remaining portion of the heated bitumen is blocked from draining by lip 74. The continued downward retreat of lip 74, however, which in turn allows the continued draining of heated bitumen which was previously retained behind lip 74, suggests that the high combustion temperatures allow bitumen transport off the bank despite the relatively low tilt angle of the interface: the newly depleted space can then be invaded by combustion-supporting fluid in order to sustain a downward combustion front, which in turn heats additional bitumens beneath the bank.

As the sustainability of the process described above consequently depends on the continued flow of mobilized bitumens away from the combustion zone and towards the production point, it may be beneficial in some cases to enhance the mobility of the released bitumens downstream of the combustion zone—possibly by preheating the propagation path of the burn front—so as to encourage the released bitumens to flow away from the advancing front in a stable manner, thereby avoiding injection-pressure build-up which might promote fingering and channelling and accompanying early oxygen breakthrough. Accordingly, as one means of preheating the propagation path, it may be advantageous to continue to conduct cyclical steam stimulation via the injection-production wells during all or part of the process described above.

Finally, it should be noted that extensive horizontal fracturing may occur in certain types of tar-sand beds and other similar formations when subjected to a cyclical steam stimulation process as described. Such horizontal fracturing may have a significant impact on the formation of the bowl-shaped zones of increased permeability and the cold humps which have been described above and which are important in the practice of the present invention. This factor should consequently be assessed for particular formations in connection with the practice of the present invention. The potential impact of this factor is one reason why the injection well 22 may preferably be infill-drilled at a later time than the original CSS wells 18 and 20, when the shape and location of the zones of increased permeability formed by the CSS process can be better determined.

It is to be understood that the invention is not limited to the exact details of construction or operation, exact materials, or exact embodiment shown and described, as obvious modifications and equivalents will be apparent to one skilled in the art. Accordingly, the invention is therefore to be limited only by the scope of the appended claims.

What is claimed is:

1. A method for the production of bitumens from a subterranean reservoir which is penetrated by a plurality of wells, comprising the steps of:

cyclically injecting fluid into and recovering bitumens from the reservoir through at least one injection-production well so as to form a zone of increased effective permeability in the reservoir about the at least one injection-production well, the zone of increased effective permeability having a lower boundary with a substantially positive gradient outwardly from the at least one injection-production well;

initiating in-situ combustion in the zone of increased permeability proximate at least one injection well, the at least one injection well being spaced apart from the at least one injection-production well;

injecting combustion-sustaining fluid into the zone of increased permeability through the at least one injection well so as to expand the in-situ combustion outwardly from the at least one injection well, whereby at least a portion of the bitumens remaining in the reservoir are caused to flow downward along the lower boundary of the zone of increased effective permeability toward the at least one injection-production well; and recovering bitumens from the reservoir through the at least one injection-production well.

2. The method of claim 1, wherein the zone of increased effective permeability about the at least one injection-production well intersects at least one other zone of increased effective permeability about at least one other injection-production well so as to form an area of communication between the zones of increased effective permeability above a body of unrecovered bitumens in the reservoir intermediate the at least one injection-production well and the at least one other injection-production well.

3. The method of claim 1, wherein the at least one injection well is in fluid communication with the zones of increased permeability in the area of communication over the body of unrecovered bitumens.

4. The method of claim 3, wherein the at least one injection well is in fluid communication with the zone of increased permeability in the area of communication proximate the uppermost portion of the body of unrecovered bitumens.

5. The method of claim 1, wherein the cyclically injected fluid is steam.

6. The method of claim 1, wherein the combustion-sustaining fluid is an oxygen-containing fluid.

7. The method of claim 6, wherein the oxygen-containing fluid is air.

8. The method of claim 6, wherein the oxygen-containing fluid is oxygen-enriched air.

9. The method of claim 1, further comprising the additional step of:

injecting steam into the zone of increased permeability through the at least one injection well.

10. A method for the production of bitumens from a subterranean reservoir which is penetrated by a plurality of spaced-apart injection-production wells, the method comprising the steps of:

cyclically injecting steam into and recovering bitumens from the reservoir through a first injection-production well and a second injection-production well so as to form a zone of increased effective permeability in the reservoir about each of the first and second injection-production wells, each zone of increased effective permeability having a lower boundary in the reservoir with a substantially positive gradient outwardly from its respective injection-production well, the zones of increased effective permeability intersecting so as to form an area of communication between each other in the upper portion of the reservoir above a cold hump laterally intermediate the first and second injection-production wells;

drilling an injection well in the reservoir, the injection well being in fluid communication with the area of communication between the zones of increased effective permeability proximate the uppermost portion of the cold hump;

initiating in-situ combustion in the area of communication between the zones of increased effective permeability proximate the injection well;

injecting oxygen-containing fluid into the area of communication between the zones of increased effective permeability through the injection well so as to expand the in-situ combustion outwardly from the injection well, whereby the heat and combustion pressure of the in-situ combustion and gravity cause bitumens from the zones of increased permeability and the cold hump to flow downwardly along the lower boundaries of the zones of increased effective permeability towards the injection-production wells; and recovering the bitumens from the zones of increased permeability and the cold hump through each of the injection-production wells.

11. The method of claim 10, further comprising the additional step of injecting steam into the zone of increased effective permeability through the injection well.

* * * * *